US010770847B2

(12) United States Patent
Luo

(10) Patent No.: US 10,770,847 B2
(45) Date of Patent: Sep. 8, 2020

(54) HIGH CURRENT DC DISPERSING AND CONVERGING CONNECTOR

(71) Applicant: TI-LANE PRECISION ELECTRONIC CO., LTD, Yongzhou, Hunan (CN)

(72) Inventor: Baojun Luo, Guangdong (CN)

(73) Assignee: TI-LANE PRECISION ELECTRONIC CO., LTD, Yongzhou (CN)

( * ) Notice: Subject to any disclaimer, the term of this patent is extended or adjusted under 35 U.S.C. 154(b) by 0 days.

(21) Appl. No.: 16/506,979

(22) Filed: Jul. 9, 2019

(65) Prior Publication Data

US 2020/0136327 A1 Apr. 30, 2020

(30) Foreign Application Priority Data

Oct. 26, 2018 (CN) ..... 2018 1 1258916

(51) Int. Cl.
*H01R 25/16* (2006.01)
*H01R 13/03* (2006.01)
(Continued)

(52) U.S. Cl.
CPC ..... *H01R 25/161* (2013.01); *H01R 13/03* (2013.01); *H01R 13/502* (2013.01); *H01R 13/5219* (2013.01); *H01R 13/64* (2013.01)

(58) Field of Classification Search
CPC .... H01R 25/161; H01R 13/03; H01R 13/502; H01R 13/64; H01R 13/5219
(Continued)

(56) References Cited

U.S. PATENT DOCUMENTS 6,280,229 B1 * 8/2001 Harting ..... H01R 4/2433 439/320
6,746,279 B1 * 6/2004 Lopez ..... H01R 9/2458 439/620.01
(Continued)

*Primary Examiner* — Hien D Vu

(57) ABSTRACT

A high current DC dispersing and converging connector comprises a dispersing and connecting terminal, a sheath I, a converging and connecting terminal and a sheath II, the dispersing and connecting terminal comprises three connecting ends I and a connecting end II; two connecting ends I are symmetrically fixed to the connecting end II; the sheath I is provided with three inserting ports I and an inserting port II; the sheath I is sleeved on an outer surface of the dispersing and connecting terminal; the tail of the connecting end II is provided with an inserting groove; the converging and connecting terminal is an umbrella-shaped copper-aluminum terminal; the sheath II is provided with two connecting ports; the sheath II is sleeved on an outer surface of the converging and connecting terminal; when the umbrella-shaped end is inserted into and fixed with the inserting groove, the inserting port II of the sheath I is inserted into and fixedly connected with the connecting port of the sheath II; and a seal ring is arranged at a contact position where the inserting port II and the connecting port are contacted. By improving the structure of the existing high current DC single-input and single-output connector, the solution reduces the convergence box, saves a connection space, makes processing more convenient, and also reduces processing time.

3 Claims, 2 Drawing Sheets

(51) Int. Cl.
*H01R 13/502* (2006.01)
*H01R 13/52* (2006.01)
*H01R 13/64* (2006.01)

(58) Field of Classification Search
USPC ..... 439/638
See application file for complete search history.

(56) References Cited

U.S. PATENT DOCUMENTS

| | | | | |
|---|---|---|---|---|
| 9,887,504 | B1 * | 2/2018 | Luo | H01R 13/4367 |
| 2017/0237197 | A1 * | 8/2017 | Wojcik | H01R 13/506<br>439/638 |
| 2018/0006523 | A1 * | 1/2018 | Ishibashi | H01R 13/6315 |

* cited by examiner

HIGH CURRENT DC DISPERSING AND CONVERGING CONNECTOR

CROSS-REFERENCE TO RELATED APPLICATIONS

This application claims priority to Chinese Patent Application No. 201811258916.1 with a filing date of Oct. 26, 2018. The content of the aforementioned applications, including any intervening amendments thereto, are incorporated herein by reference.

TECHNICAL FIELD

The disclosure relates to the field of connectors for solar panels, and particularly relates to a high current DC dispersing and then converging connector.

BACKGROUND OF THE PRESENT INVENTION

With the development of the society and the advancement of science and technology, environmentally-friendly and pure energy has gradually attracted human attention. As an environmentally-friendly and endlessly accessible new energy source, photovoltaics are valued by people. The photovoltaic panel is a common device for converting solar energy, and has high requirements for connectors during the use of the photovoltaic panel, which requires high electrical connection tightness, seal and firmness.

The existing electrical connector extension wires are widely used in connection carriers for photovoltaic panels and are exposed to the outdoors. However, in the existing industry, a high current DC electrical connector basically adopts single-input and single-output, and then the current converges through a convergence box, which is high in cost and complicated in installation.

How to reduce the market cost pressure by improving the structure of the existing high current DC single-input and single-output connector is a problem to be urgently solved by the applicant.

SUMMARY OF PRESENT INVENTION

Aiming at the defects in the prior art, the disclosure provides a high current DC dispersing and then converging connector.

In order to achieve the above aim, the technical solution adopted by the disclosure is as follows: a high current DC dispersing and converging connector comprises a dispersing and connecting terminal, a sheath I, a converging and connecting terminal and a sheath II, the dispersing and connecting terminal comprises three connecting ends I and a connecting end II; one connecting end I and the connecting end II are in the same horizontal plane; the other two connecting ends I are symmetrically fixed to the connecting end II; the sheath I is provided with three inserting ports I and an inserting port II; the sheath I is sleeved on an outer surface of the dispersing and connecting terminal; the three connecting ends I of the dispersing and connecting terminal are respectively arranged in the three inserting ports I; the tail of the connecting end II is provided with an inserting groove; the connecting end II is arranged in the inserting port II; the converging and connecting terminal is an umbrella-shaped copper-aluminum terminal; the umbrella end of the umbrella-shaped copper-aluminum terminal is inserted into and matched with the inserting groove; the sheath II is provided with two connecting ports; the sheath II is sleeved on an outer surface of the converging and connecting terminal; the umbrella end and a cable connecting end of the umbrella-shaped copper-aluminum terminal are respectively arranged in the two connecting ports; when the umbrella-shaped end is inserted into and fixed with the inserting groove, the inserting port II of the sheath I is inserted into and fixedly connected with the connecting port of the sheath II; and a seal ring is arranged at a contact position where the inserting port II and the connecting port are contacted.

With the technical solution of the disclosure, the following technical effects are produced: 1. the convergence and connection of multi-point dispersed current can be realized; and 2. the convergence box is avoided, and a connection space is saved; processing is more convenient, and processing time is also reduced.

In a further improvement, the top of the inserting port II is provided with a fool-proof convex strip; and the top of the connecting port is provided with a groove matched with the fool-proof convex strip. The arrangement of the fool-proof convex strip can prevent the connector from being inserted incorrectly. Once an error is generated, the sheath I and the sheath II cannot be inserted into and fixedly connected due to the arrangement of the fool-proof convex strip.

In a further improvement, the high current DC dispersing and converging connector further comprises a positioning clamping block; the positioning clamping block is provided with a positioning part I and a positioning part II; the positioning part I is clamped and fixed on the connecting end I which is in the same horizontal plane as the connecting end II; and the positioning part II is clamped and fixed on one of the other two connecting ends I. The design of the positioning clamping block can effectively prevent the connecting end I from being tilted and deformed after the connector is inserted and unplugged for multiple times, thereby ensuring the connection effect of the connector.

In a further improvement, the positioning clamping block is also provided with a positioning clamping plate; and the positioning clamping block is fixed into the sheath I through the positioning clamping plate. The positioning clamping plate is designed so that the positioning clamping block can be better clamped among the two connecting ends I and the sheath, thereby realizing more accurate and firmer positioning.

DETAILED DESCRIPTION OF PREFERRED EMBODIMENTS

The preferred embodiments of the disclosure are further described below with reference to the drawings.

Figure 1:
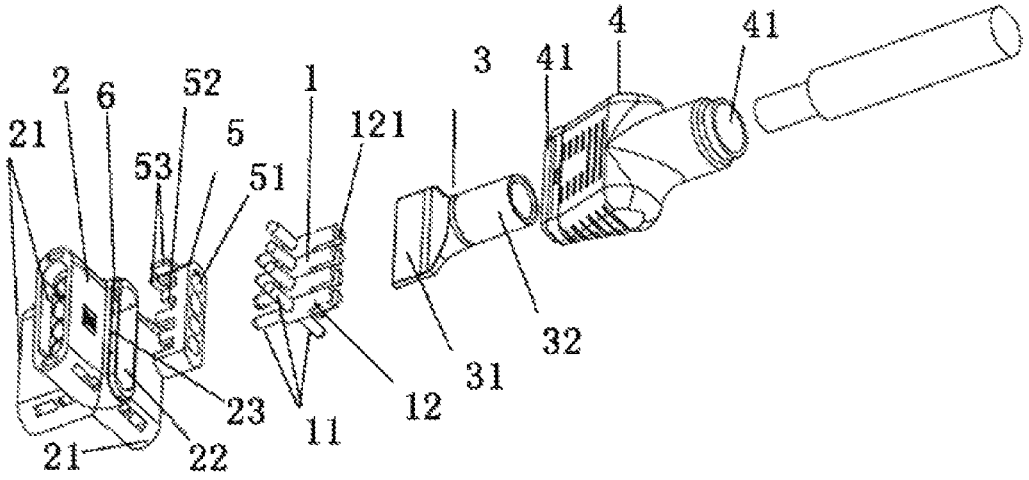
FIG. 1 is an exploded diagram of a high current DC dispersing and converging connector.
Figure 2:
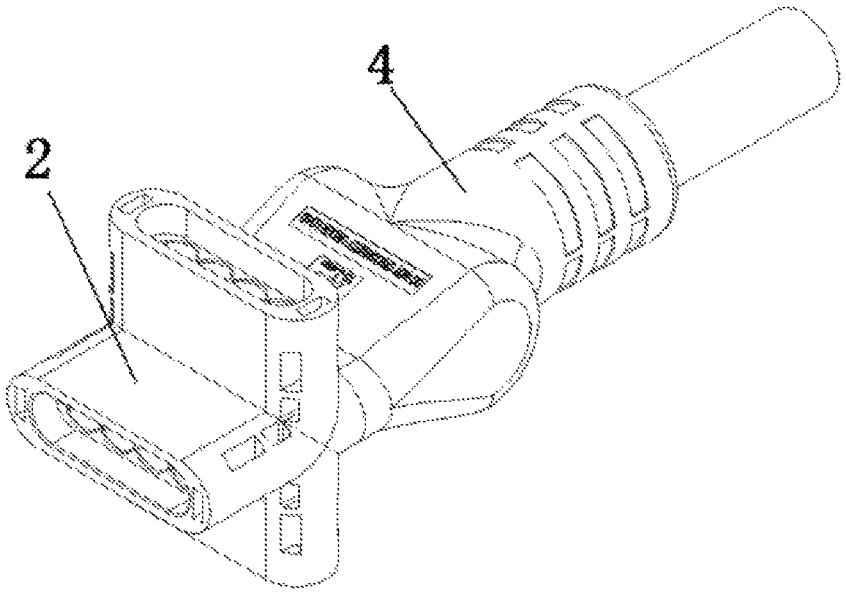
FIG. 2 is a top view of a high current DC dispersing and converging connector.
Figure 3:
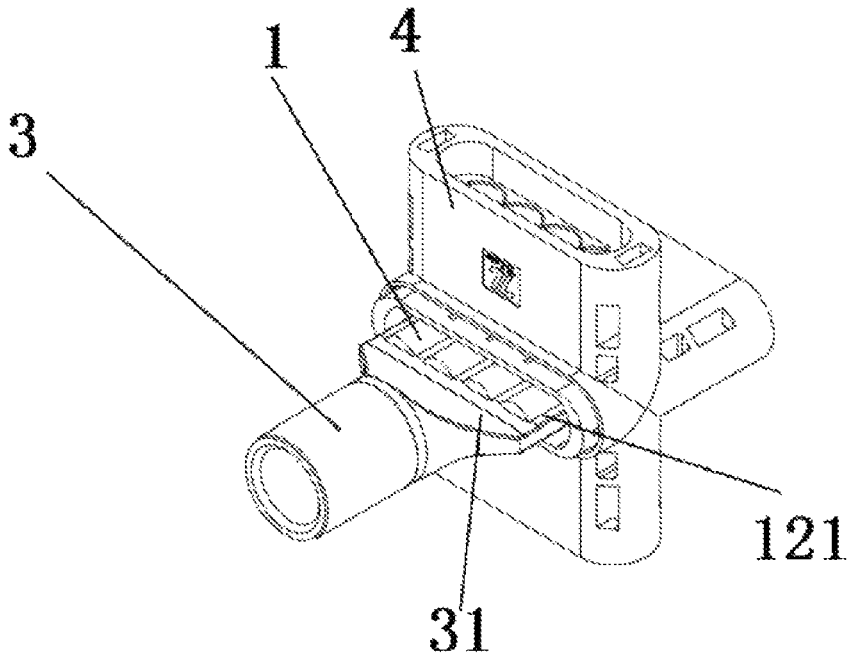
FIG. 3 is a structural schematic diagram when a dispersing and connecting terminal of a high current DC dispersing and converging connector is inserted into and fixed with a converging and connecting terminal.

As shown in FIG. 1 to FIG. 3, a high current DC dispersing and converging connector comprises a dispersing and connecting terminal 1, a sheath I 2, a converging and connecting terminal 3, a sheath II 4 and a positioning clamping block 5.

The dispersing and connecting terminal comprises three connecting ends I 11 and a connecting end II 12; one connecting end I and the connecting end II are in the same horizontal plane; the other two connecting ends I are symmetrically fixed to the connecting end II; the sheath I 2 is provided with three inserting ports I 21 and an inserting port I 22; the sheath I is sleeved on an outer surface of the dispersing and connecting terminal; the three connecting ends I of the dispersing and connecting terminal are respectively arranged in the three inserting ports I; the tail of the connecting end II 12 is provided with an inserting groove 121; and the connecting end II12 is arranged in the inserting port II 22.

The converging and connecting terminal 3 is an umbrella-shaped copper-aluminum terminal; the umbrella end of the umbrella-shaped copper-aluminum terminal is inserted into and matched with the inserting groove; the sheath II 4 is provided with two connecting ports 41; the sheath I 2 is sleeved on an outer surface of the converging and connecting terminal; the umbrella end 31 and a cable connecting end 32 of the umbrella-shaped copper-aluminum terminal are respectively arranged in the two connecting ports 41; when the umbrella-shaped end is inserted into and fixed with the inserting groove, the inserting port II of the sheath I is inserted into and fixedly connected with the connecting port of the sheath II; and a seal ring 6 is arranged at a contact position where the inserting port II and the connecting port are contacted. The top of the inserting port II is provided with a fool-proof convex strip 23; and the top of the connecting port 41 is provided with a groove matched with the fool-proof convex strip.

The positioning clamping block 5 is provided with a positioning part I 51, a positioning part II 52 and a positioning clamping plate 53. The positioning part I 51 is clamped and fixed on the connecting end I which is in the same horizontal plane as the connecting end II; and the positioning part II is clamped and fixed on one of the other two connecting ends I. The positioning clamping block is fixed into the sheath I through the positioning clamping plate.

In order to better illustrate the technical solution of the disclosure, the design principle of the disclosure is described: in the technical solution, the inserting groove is milled at the tail of the dispersing and connecting terminal for facilitating current convergence; the converging and connecting terminal is designed into the umbrella-shaped copper-aluminum terminal; the umbrella-shaped end is combined with the inserting groove of the dispersing and connecting terminal; and the multi-path dispersed current is connected through the metal terminal of the electrical connector, and then is connected with a main trunk cable through the umbrella-shaped copper-aluminum terminal to complete the converging function of the dispersed current, so that multi-path currents are converged and then transmitted to the next device through one wire.

The above embodiments are only used to describe the technical concepts and features of the disclosure, and are intended to enable those of ordinary skill in the art to understand and implement the contents of the disclosure, not intended to limit the protection scope of the disclosure. Any equivalent variation or modification made in accordance with the spirit and essence of the disclosure shall be included in the protection scope of the disclosure.

I claim:

1. A high current DC dispersing and converging connector, comprising a dispersing and connecting terminal, a sheath I, a converging and connecting terminal and a sheath II, wherein the dispersing and connecting terminal comprises three connecting ends I and a connecting end II; one connecting end I and the connecting end II are in a same horizontal plane; the other two connecting ends I are symmetrically fixed to the connecting end II; the sheath I is provided with three inserting ports I and an inserting port II; the sheath I is sleeved on an outer surface of the dispersing and connecting terminal; the three connecting ends I of the dispersing and connecting terminal are respectively arranged in the three inserting ports I; a tail of the connecting end II is provided with an inserting groove; the connecting end II is arranged in the inserting port II; the converging and connecting terminal is an umbrella-shaped copper-aluminum terminal; an umbrella end of the umbrella-shaped copper-aluminum terminal is inserted into and matched with the inserting groove; the sheath II is provided with two connecting ports; the sheath II is sleeved on an outer surface of the converging and connecting terminal; the umbrella end and a cable connecting end of the umbrella-shaped copper-aluminum terminal are respectively arranged in the two connecting ports; when the umbrella-shaped end is inserted into and fixed with the inserting groove, the inserting port II of the sheath I is inserted into and fixedly connected with the connecting port of the sheath II; and a seal ring is arranged at a contact position where the inserting port II and the connecting port are contacted;

wherein the high current DC dispersing and converging connector further comprising a positioning clamping block; and wherein the positioning clamping block is provided with a positioning part I and a positioning part II; the positioning part I is clamped and fixed on the connecting end I which is in the same horizontal plane as the connecting end II; and the positioning part II is clamped and fixed on one of the other two connecting ends I.

2. The high current DC dispersing and converging connector according to claim 1, wherein a top of the inserting port II is provided with a fool-proof convex strip; and a top of the connecting port is provided with a groove matched with the fool-proof convex strip.

3. The high current DC dispersing and converging connector according to claim 1, wherein the positioning clamping block is further provided with a positioning clamping plate; and the positioning clamping block is fixed into the sheath I through the positioning clamping plate.

* * * * *